US010589563B2

(12) United States Patent
Odaka

(10) Patent No.: US 10,589,563 B2
(45) Date of Patent: Mar. 17, 2020

(54) COMPOSITE WRITING IMPLEMENT

(71) Applicant: KOTOBUKI & CO., LTD., Kawagoe-shi (JP)

(72) Inventor: Tadao Odaka, Kawagoe (JP)

(73) Assignee: KOTOBUKI & CO., LTD., Kawagoe-Shi, Saitama (JP)

( * ) Notice: Subject to any disclaimer, the term of this patent is extended or adjusted under 35 U.S.C. 154(b) by 0 days.

(21) Appl. No.: 15/773,096

(22) PCT Filed: Nov. 11, 2016

(86) PCT No.: PCT/JP2016/083523
§ 371 (c)(1),
(2) Date: May 2, 2018

(87) PCT Pub. No.: WO2017/104324
PCT Pub. Date: Jun. 22, 2017

(65) Prior Publication Data

US 2018/0319202 A1 Nov. 8, 2018

(30) Foreign Application Priority Data

Dec. 17, 2015 (JP) ..... 2015-246473

(51) Int. Cl.
*B43K 24/14* (2006.01)
*B43K 27/12* (2006.01)
*B43K 27/02* (2006.01)

(52) U.S. Cl.
CPC ..... *B43K 24/146* (2013.01); *B43K 24/14* (2013.01); *B43K 27/12* (2013.01); *B43K 27/02* (2013.01)

(58) Field of Classification Search
CPC ..... B43K 24/06; B43K 24/14; B43K 24/146
(Continued)

(56) References Cited

U.S. PATENT DOCUMENTS 4,269,524 A * 5/1981 Hashimoto ..... B43K 24/06 401/116
4,283,151 A * 8/1981 Sekiguchi ..... B43K 27/02 401/33

(Continued)

FOREIGN PATENT DOCUMENTS

CN 1616247 A 5/2005
CN 1701969 A 11/2005

(Continued)

OTHER PUBLICATIONS

International Search Report (ISR) (PCT Form PCT/ISA/210), in PCT/JP2016/083523, dated Jan. 17, 2017.

(Continued)

*Primary Examiner* — David P Angwin
*Assistant Examiner* — Bradley S Oliver
(74) *Attorney, Agent, or Firm* — McGinn I. P. Law Group, PLLC.

(57) ABSTRACT

A composite writing implement according to an embodiment includes a barrel, writing shafts housed in the barrel, a cam main body including a cam projection, an end surface extending along the cam projection, and a latch recess provided in the cam projection, and sliders configured to be connected to respective rear ends of the writing shafts, and include a cam configured to be latchable to the latch recess, and have a sliding contact surface to be pressed against the end surface, wherein the end surface includes a first inclined portion that is positioned on the front end side of the cam projection and is inclined by a first incline angle, and a second inclined portion that is positioned further toward the rear end side of the cam projection than the first inclined portion, and is inclined by a second incline angle that is larger than the first incline angle.

14 Claims, 8 Drawing Sheets

(58) Field of Classification Search
USPC ..... 401/30, 110
See application file for complete search history.

(56) References Cited

U.S. PATENT DOCUMENTS

| | | | | | |
|---|---|---|---|---|---|
| 5,056,947 | A * | 10/1991 | Kubota | B43K 24/146 401/29 |
| 5,642,953 | A * | 7/1997 | Kobayashi | B43K 24/14 401/30 |
| 5,899,618 | A * | 5/1999 | Kobayashi | B43K 1/086 401/29 |
| 6,939,069 | B2 * | 9/2005 | Odaka | B43K 24/146 401/30 |
| 7,128,491 | B2 * | 10/2006 | Kobayashi | B43K 7/03 401/188 A |
| 2004/0114985 | A1 | 6/2004 | Ono et al. | |
| 2005/0100387 | A1 | 5/2005 | Odaka | |
| 2005/0265767 | A1 | 12/2005 | Kageyama et al. | |
| 2010/0316431 | A1 | 12/2010 | Rolion et al. | |
| 2012/0315074 | A1 | 12/2012 | Roberts et al. | |

FOREIGN PATENT DOCUMENTS

| | | | |
|---|---|---|---|
| CN | 101970248 | A | 2/2011 |
| CN | 103648794 | A | 3/2014 |
| JP | 2001-150872 | A | 6/2001 |
| JP | 2001-293996 | A | 10/2001 |
| JP | 2005-161829 | A | 6/2005 |
| JP | 2006-272666 | A | 10/2006 |
| JP | 2006272666 | A * | 10/2006 |

OTHER PUBLICATIONS

Singapore Office Action, dated Mar. 26, 2019, in Singapore Application No. 11201804953W and English Translation thereof.
Chinese Office Action, dated Jul. 26, 2019, in Chinese Application No. 201680061084.7 and English Translation thereof.
Taiwanese Office Action, dated Jul. 2, 2019, in Taiwanese Application No. 105135141.
Extended European Search Report, dated Jul. 11, 2019, in European Application No. 16 875 308.5.
Singapore Office Action, dated Nov. 21, 2019, in Singapore Application No. 11201804953W and English Translation thereof.

* cited by examiner

[Fig.1]
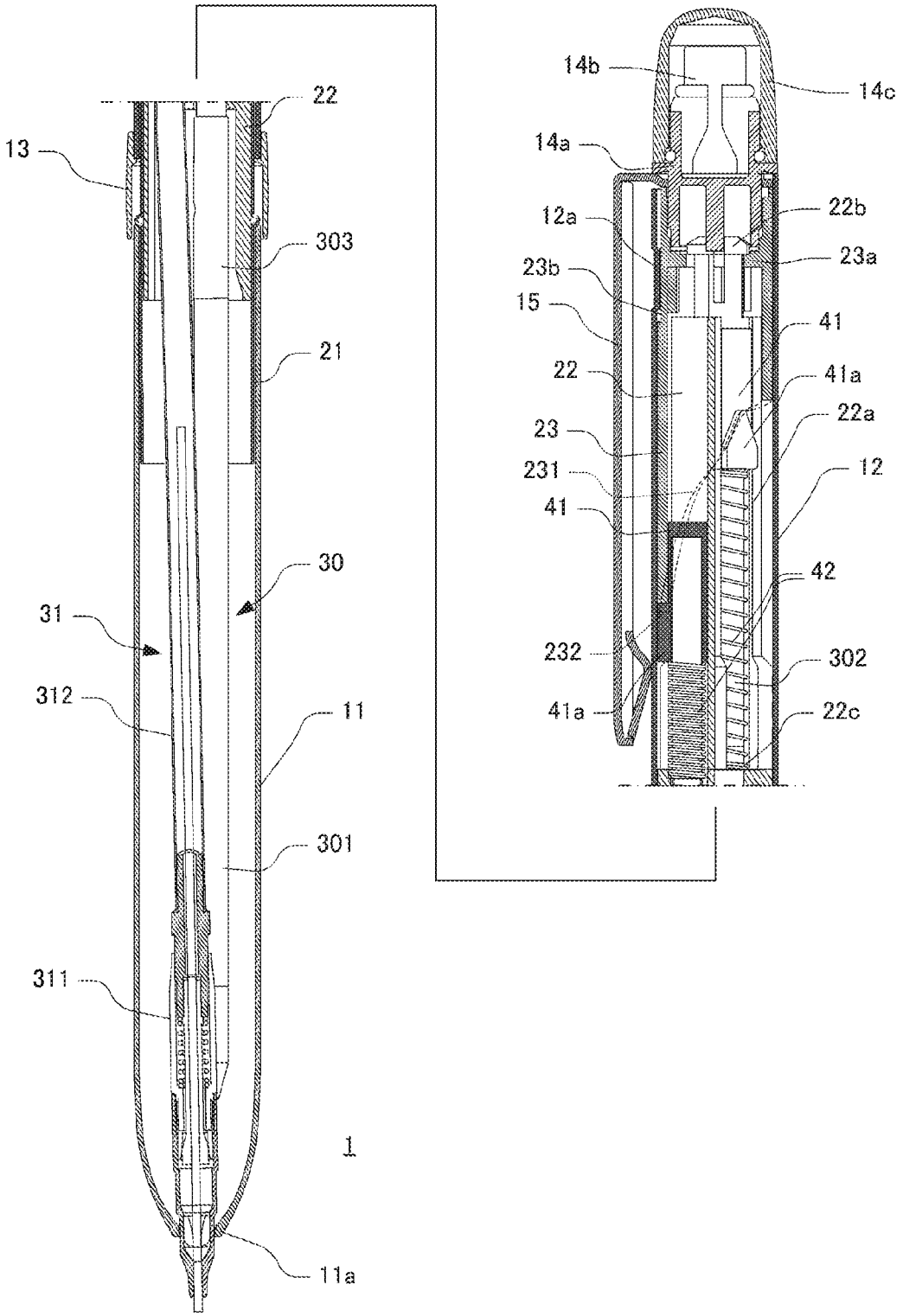

[Fig. 2]
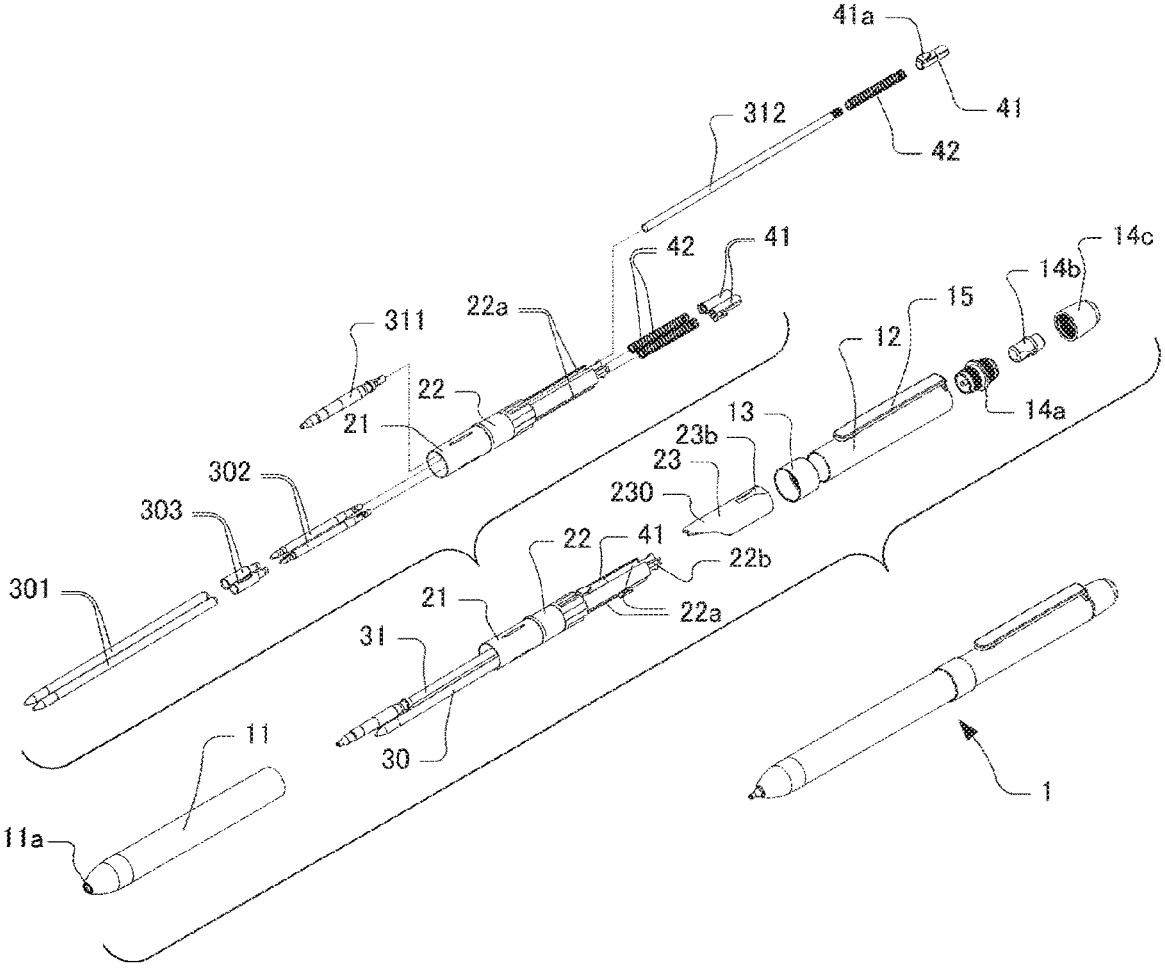

[Fig. 3]
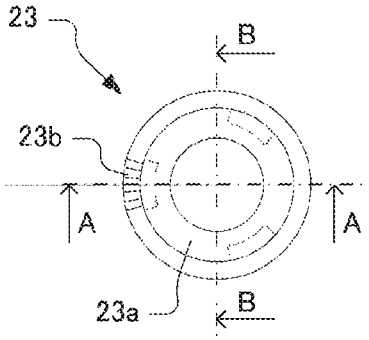
[Fig. 4]
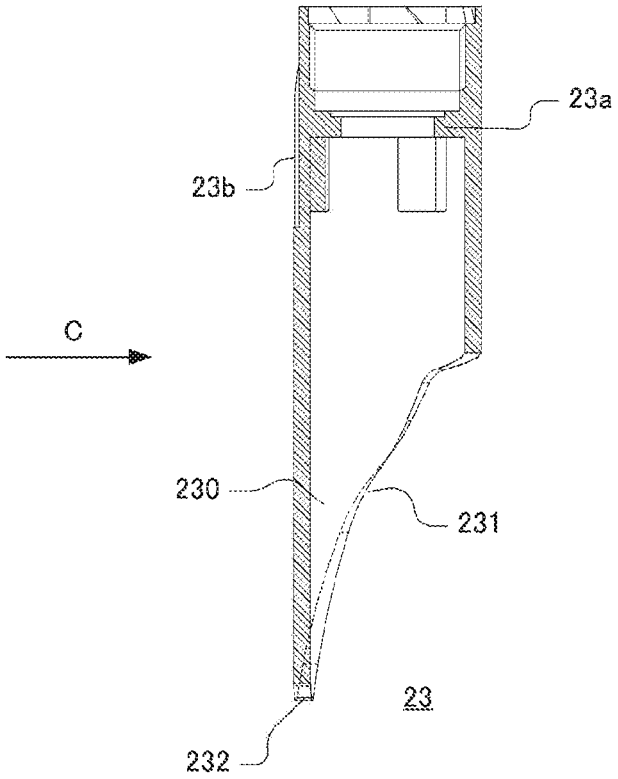

[Fig. 5]
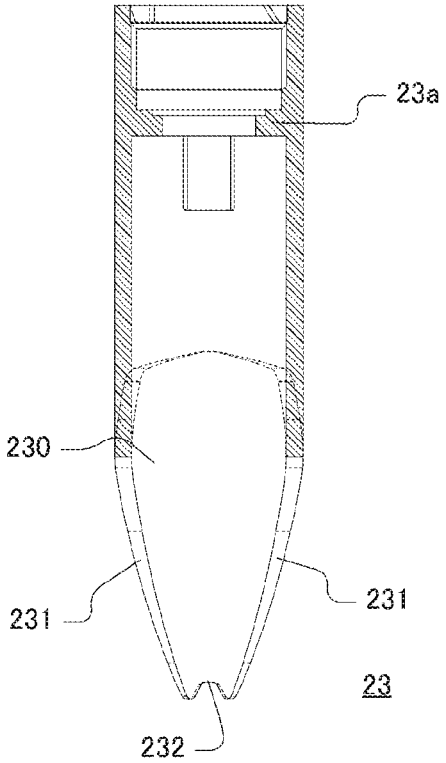
[Fig. 6]
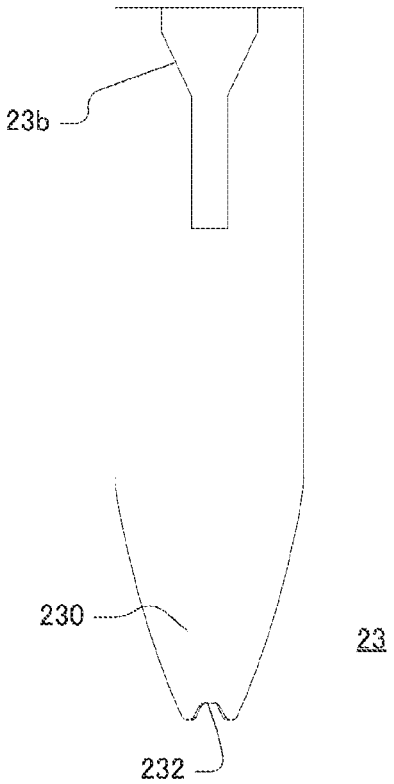

[Fig. 7]
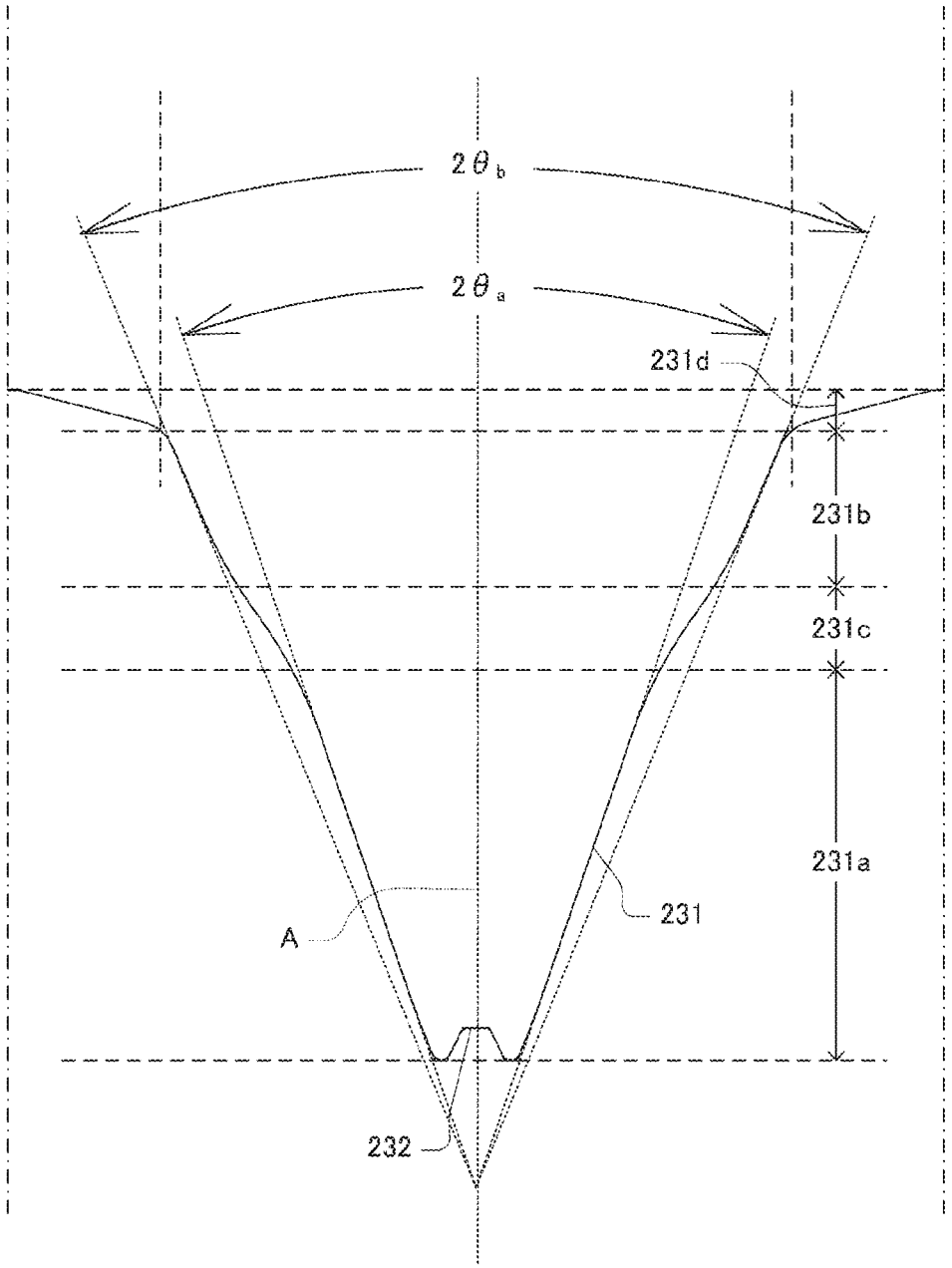

[Fig. 8]
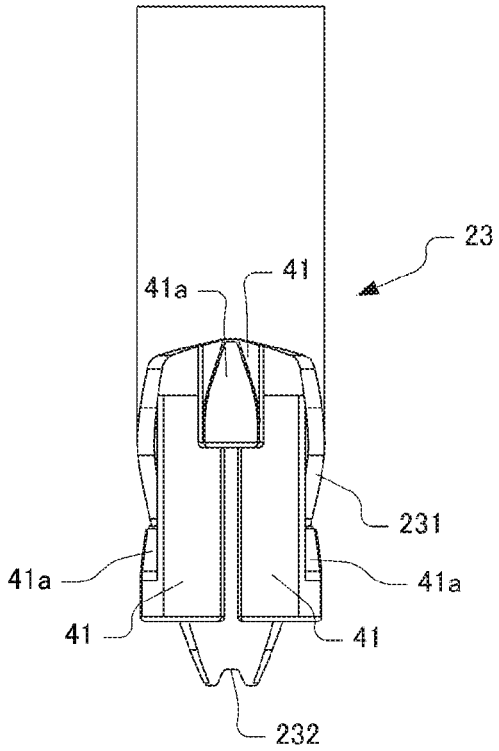
[Fig.9]
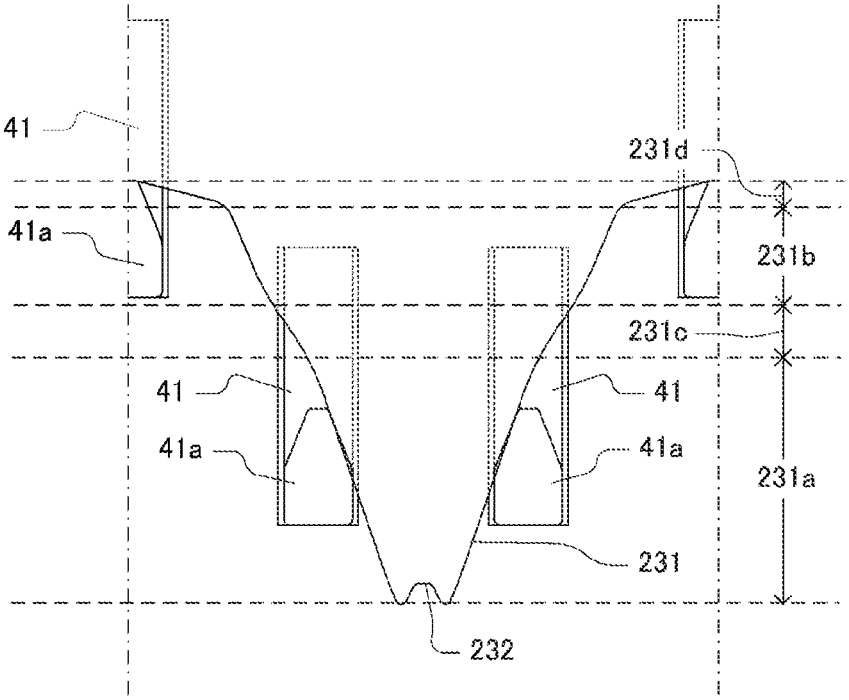

[Fig.10]
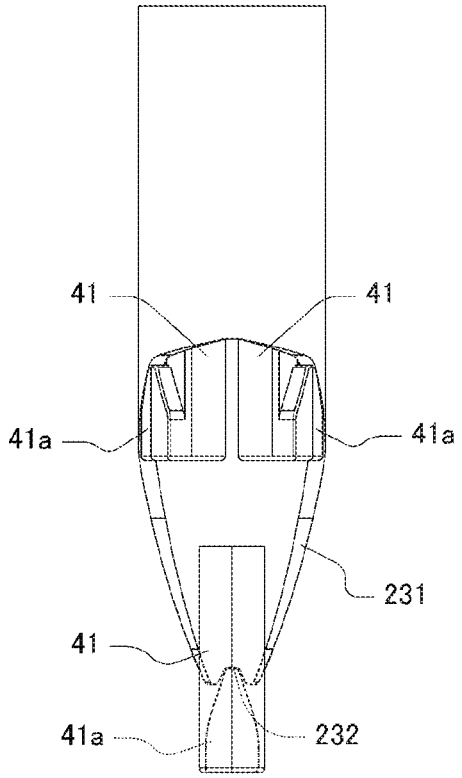
[Fig.11]
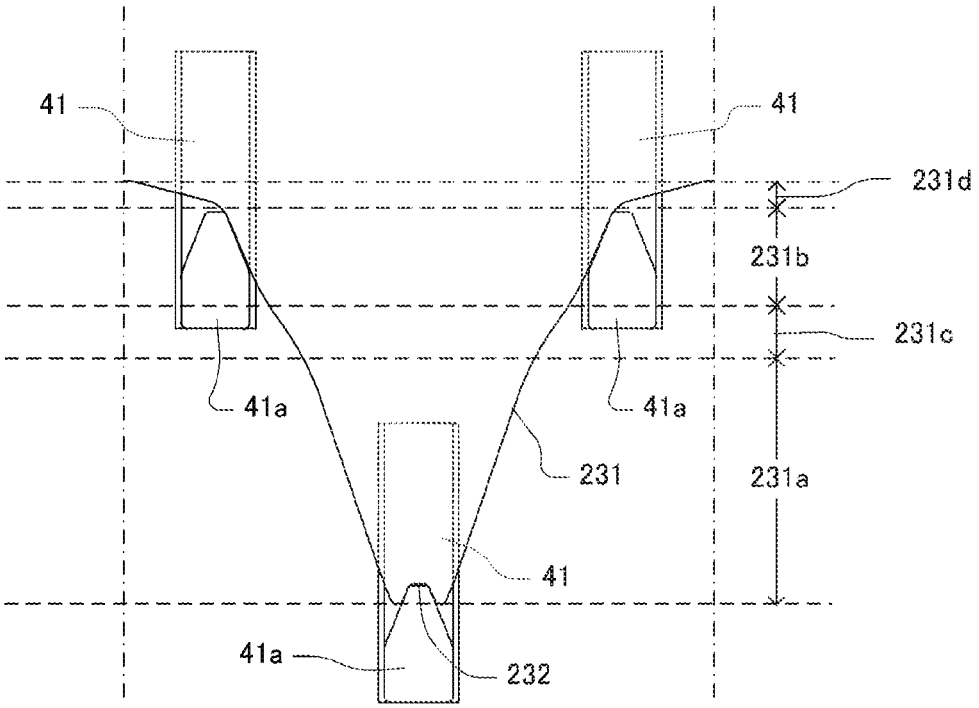

[Fig.12]
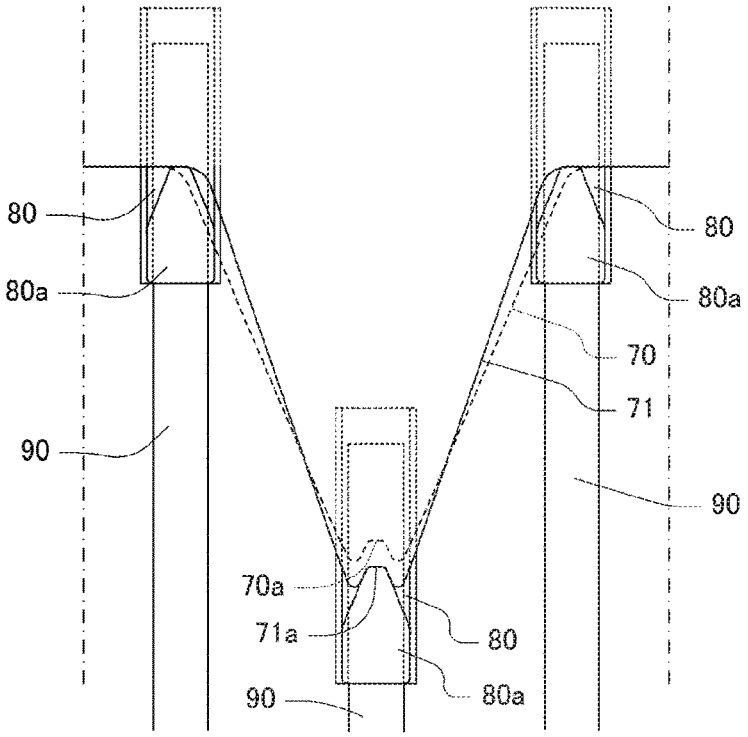
[Fig.13]
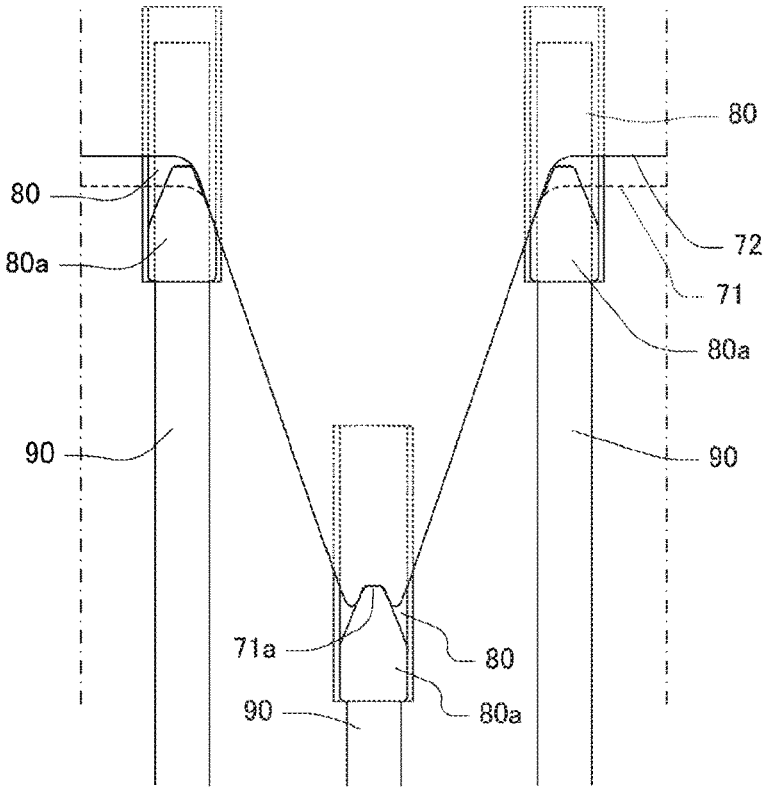

COMPOSITE WRITING IMPLEMENT

TECHNICAL FIELD

The present invention relates to a composite writing implement in which a plurality of writing shafts are housed in a barrel such that a front end of one of the plurality of writing shafts can be caused to project selectively from the barrel.

BACKGROUND ART

In a conventional composite writing implement, a plurality of desired writing shafts, such as ball pen writing shafts or mechanical pencil writing shafts, are housed in a barrel such that the front end of one of the writing shafts can be caused to project selectively from an opening provided in the front end of the barrel.

Conventional examples of this type of composite writing implement include a composite writing implement having a barrel formed from a front barrel and a rear barrel configured to be able to rotate relative to the front barrel, a cam main body configured to be not able to rotate relative to the rear barrel, and a slider configured to be not able to rotate relative to the front barrel and be coupled to a rear end portion of each writing shaft, wherein the cam main body is provided with a V-shaped cam projection projecting frontward, a cam surface extending along the cam projection so as to face frontward, and a latch portion provided on a part of the cam surface at an apex of the cam projection, the slider is provided with a V-shaped cam projecting rearward, and a sliding contact surface extending along the cam so as to face rearward, and when the sliding contact surface of the slider is pressed against the cam surface of the cam main body and the rear barrel and the front barrel are rotated relative to each other, a front end of a writing shaft is caused to project selectively from a front end opening in the barrel (see PTL 1).

CITATION LIST

Patent Literature

[PTL 1] Japanese Patent Application Publication No. 2005-161829 (see paragraph 0008, for example)

SUMMARY OF INVENTION

Technical Problem

In the past, there has been demand for increases in the amount by which a writing shaft of a composite writing implement is caused to project from the front end opening in the barrel and the amount by which the writing shaft is drawn in through the front end opening in the barrel in order to be housed therein. To provide a composite writing implement that satisfies these conventional requirements, a composite writing implement in which a front end of a writing shaft is caused to project by rotating a rear barrel and a front barrel relative to each other must be formed with an increased movement amount, i.e. an increased distance from a position of the front end of the writing shaft when housed in the barrel to a position of the front end of the writing shaft when projecting from the front end opening in the barrel.

As a method of increasing the movement amount of the writing shaft, the projection amount of the writing shaft may be increased, or in other words the position of the front end of the writing shaft in the projecting condition may be shifted further toward the front end side. A cam main body in which the projection amount of the writing shaft has been increased will now be described.

A cam main body shown in FIG. 12 includes a cam projection that projects further toward the front end side than a cam projection provided with an end surface 70 and a latch recess 70*a*, in which the projection amount of the writing shaft has not been increased. Further, an end surface 71 of the cam projection is inclined more steeply than the end surface 70 such that a latch recess 71*a* thereof is positioned further toward the front end side than the latch recess 70*a*. Three sliders 80 that are respectively connected to rear ends of writing shafts 90 and each include a substantially V-shaped cam 80*a* having a sliding contact surface that faces a rear end side are moved by the cam main body to the front end side of the composite writing implement.

When switching from a housed condition in which the writing shafts 90 are housed in the barrel to a projecting condition in which one of the writing shafts 90 is caused to project from the barrel, in the case of the cam projection having the end surface 70 and the latch recess 70*a*, the cam 80*a* corresponding to the writing shaft 90 to be caused to project slides along the end surface 70 to the latch recess 70*a*, and is latched thereby. Here, the respective sliding contact surfaces of the two remaining cams 80*a* contact the end surface 70, and as a result of this contact, the latched cam 80*a* can be caused to generate a rotational reaction force when traveling over the latch recess 70*a*. In response thereto, a user can halt a rotation operation, and as a result, the writing shaft 90 can be caused to project with stability.

Meanwhile, when a writing shaft is caused to project in a case where the incline is formed comparatively steeply in order to shift the apex of the cam projection, or in other words the latch recess 71*a*, further toward the front end side, as in the end surface 71, a gap is formed between the end surface 71 and the two cams 80*a* other than the cam that is latched to the latch recess 71*a* when causing the writing shaft to project. When this gap is formed, the aforementioned rotational reaction force is not generated, and therefore the latched cam 80*a* easily passes over the latch recess 71*a*. As a result, the projected writing shaft 90 will lack stability.

When, on the other hand, the end surface 71 shown in FIG. 12 is further modified to an end surface 72 formed such that the housed position of the writing shaft is further toward the rear end side, as shown in FIG. 13, a distance between the end surface 72 and the sliding contact surfaces of the cams 80*a* corresponding to the writing shafts in the housed position can be reduced, and as a result, the gap between the end surface 72 and the cams 80*a* can be eliminated. However, when the incline angle of both the end surface 71 shown in FIG. 12 and the end surface 72 shown in FIG. 13 is made steeper, an increase occurs in the amount of relative rotation between the rear barrel and the front barrel, or in other words an amount of rotary torque required in an operation for rotating the cam main body about a central axis of the barrel, leading to a reduction in the operability of the composite writing implement. In other words, a problem exists in that when the movement amount of the writing shaft is increased, the amount of rotary torque required in the operation to rotate the cam main body also increases.

An embodiment of the present invention has been designed to solve the problem described above, and an object thereof is to provide a composite writing implement with which it is possible to suppress an increase in an amount of rotary torque required during an operation to rotate a cam main body when a movement amount of a writing shaft is increased.

Solution to Problem

To solve the problem described above, a composite writing implement according to an embodiment of the present invention includes; a barrel having an opening provided in a front end side thereof; a plurality of writing shafts housed in the barrel; a cam main body configured to rotate about a central axis of the barrel, and include a cam projection projecting toward the front end side of the composite writing implement (and the barrel), an end surface extending along the cam projection so as to face the front end side of the composite writing implement (and the barrel), and a latch recess provided in an apex part of the cam projection; and a plurality of sliders configured to be connected to respective rear ends of the plurality of writing shafts, and include a cam configured to be latchable to the latch recess of the cam main body, and have a sliding contact surface facing a rear end side of the composite writing implement to be pressed against the end surface of the cam main body, wherein the end surface of the cam main body includes a first inclined portion that is positioned on the cam projection on the front end side of the composite writing implement and is inclined relative to the central axis of the barrel by a first incline angle, and a second inclined portion that is positioned on the cam projection further toward the rear end side of the composite writing implement than the first inclined portion, and is inclined relative to the central axis of the barrel by a second incline angle that is larger than the first incline angle.

Advantageous Effects of Invention

According to this embodiment of the present invention, it is possible to provide a composite writing implement with which it is possible to suppress an increase in an amount of rotary torque required during an operation to rotate the cam main body when a movement amount of the writing shaft is increased.

BRIEF DESCRIPTION OF DRAWINGS

FIG. 1 is a sectional view illustrating a composite writing implement according to an embodiment of the present invention, deployed along a plane that includes the central axis of the composite writing implement.

FIG. 2 is an exploded perspective view of the composite writing implement according to this embodiment of the present invention.

FIG. 3 is a view illustrating a cam main body according to this embodiment of the present invention from the rear.

FIG. 4 is a sectional view illustrating the cam main body of FIG. 3 in the direction of an arrow A-A, deployed along a plane that includes the central axis of the cam main body.

FIG. 5 is a sectional view illustrating the cam main body of FIG. 3 in the direction of an arrow B-B, deployed along a plane that includes the central axis of the cam main body.

FIG. 6 is a view illustrating the cam main body according to this embodiment of the present invention from the direction of an arrow C in FIG. 4.

FIG. 7 is a deployment diagram illustrating an end surface of the cam main body according to this embodiment of the present invention when deployed on a plane.

FIG. 8 is a view illustrating a relationship between the cam main body and cams in a housed condition according to this embodiment of the present invention.

FIG. 9 is a deployment diagram illustrating the relationship between the cam main body and the cams in the housed condition according to this embodiment of the present invention when deployed on a plane.

FIG. 10 is a view illustrating the relationship between the cam main body and the cams in a projecting condition according to this embodiment of the present invention.

FIG. 11 is a deployment diagram illustrating the relationship between the cam main body and the cams in the projecting condition according to this embodiment of the present invention when deployed on a plane.

FIG. 12 is a deployment diagram illustrating a cam main body and cams deployed on a plane in a case where a movement amount of a writing shaft of a composite writing implement has been increased in order to illustrate a relationship between the cam main body and the cams in a case where the movement amount of the writing shaft has been increased.

FIG. 13 is a deployment diagram illustrating a cam main body and cams deployed on a plane in a case where a draw-in amount of a writing shaft of a composite writing implement has been increased in order to illustrate a relationship between the cam main body and the cams in a case where the draw-in amount of the writing shaft has been increased.

DESCRIPTION OF EMBODIMENTS

An embodiment of the present invention will be described below with reference to the figures.

First, a configuration of a composite writing implement (combined writing instrument) 1 according to this embodiment will be described. The composite writing implement 1 is a writing implement in which a plurality of writing shafts are housed in a barrel, and one of the housed writing shafts is caused to project selectively. In the following description, an extension direction of a central axis of the composite writing implement (a lengthwise direction of the columnar composite writing implement) will be referred to as the central axis direction (or simply the "axial direction"), an end of the axial direction on which the writing shaft is caused to project will be referred to as the front end of the composite writing implement, and an opposite side end thereto will be referred to as the rear end of the composite writing implement. FIG. 1 is a sectional view illustrating the composite writing implement 1 in a condition where a mechanical pencil writing shaft has been caused to project selectively, and FIG. 2 is an exploded perspective view of the composite writing implement 1.

As shown in FIGS. 1 and 2, the composite writing implement 1 includes a front barrel 11, a rear barrel 12, a barrel ring 13, an eraser holder 14*a*, an eraser 14*b*, an eraser cover 14*c*, a fitting cylinder 21, a guiding cylinder 22, two ball pen writing shafts 30 one containing black ink and the other containing red ink, a single mechanical pencil writing shaft 31 having a writing lead that can be fed out and clamped, sliders 41, and springs 42.

The front barrel 11 is a substantially cylindrical member that forms a barrel of the composite writing implement 1 by being connected to the rear barrel 12 via the fitting cylinder 21 and so on, as will be described in detail below, so as to be capable of rotating relative to the rear barrel 12. The barrel according to this embodiment houses the two ball pen writing shafts 30 and the single mechanical pencil writing shaft 31 as a plurality of writing shafts. Further, an opening 11*a* through which one of the plurality of housed writing shafts is caused to project selectively is formed in the front barrel 11 on the front end side of the composite writing implement 1, which is formed to taper toward the front.

The rear barrel 12 is a cylindrical member that forms the barrel of the composite writing implement 1 by being connected to the front barrel 11 via the fitting cylinder 21 and so on, as will be described in detail below, so as to be capable of rotating relative to the front barrel 11.

The barrel ring 13 is a cylindrical member that is fitted by an inner periphery thereof to a front end outer peripheral portion of the rear barrel 12 so as to cover a connection part between the front barrel 11 and the rear barrel 12.

The eraser holder 14*a* has a cylindrical outer peripheral wall, and as will be described in detail below, is configured such that a front end of an engagement projection that projects frontward from a partition wall provided in a central portion thereof engages with a latch flange 22*b* of the guiding cylinder 22 so as to be capable of rotating relative thereto within a cam main body 23 fixed within the rear barrel 12. The eraser 14*b* is inserted into the eraser holder 14*a* from a rear end side thereof, and the eraser cover 14*c* is fitted thereon. Further, a screw thread is formed in a front portion outer peripheral surface of the eraser holder 14*a* and screwed to a screw thread formed in a rear portion inner peripheral surface of the cam main body 23 such that a base portion of a clip 15 is clamped to the rear end of the rear barrel 12.

The fitting cylinder 21 is a cylindrical member that is disposed inside the barrel, fitted to the front barrel 11 detachably but so as to be incapable of rotating relative thereto, and joined to the guiding cylinder 22, which is latched to the rear barrel 12 so as to be capable of rotating relative thereto. A rear portion inner peripheral surface of the fitting cylinder 21 is joined to a front portion outer peripheral surface of the guiding cylinder 22, and the plurality of writing shafts are inserted into a tube formed by the fitting cylinder 21 and the guiding cylinder 22.

The guiding cylinder 22 is a member that is disposed in the barrel, and has a cylindrical front portion and a columnar rear portion. A partition 22*c* is provided in an intermediate portion between the cylindrical front portion and the columnar rear portion of the guiding cylinder 22. The front portion of the guiding cylinder 22 is joined to the rear portion of the fitting cylinder 21 so as to be incapable of rotating relative to the front barrel. As will be described in detail below, the rear portion of the guiding cylinder 22 is latched to the cam main body 23, which is fixed to the rear barrel 12, so as to be capable of rotating relative thereto. Three guiding grooves 22*a* extending from the rear end toward the front end side are formed in three locations separated from each other by a predetermined distance in a circumferential direction of the rear portion of the guiding cylinder 22. The guiding grooves 22*a* respectively guide axial direction sliding motions of the sliders 41, as will be described in detail below. Three latch flanges 22*b* are formed in the rear end portion of the guiding cylinder 22, and these three latch flanges 22*b* are latched to an inner peripheral step portion 23*a* (see FIG. 3) on an inner peripheral wall of the cam main body 23 so as to be capable of rotating relative thereto, as will be described in detail below.

The cam main body 23 is a substantially cylindrical member formed with a cam projection 230 that projects toward the front end side, and is disposed fixedly inside the rear barrel 12. The inner peripheral step portion 23*a* (see FIG. 3) is formed on the inner peripheral wall of the cam main body 23 so as to form a circular opening when seen from the rear. The latch flanges 22*b* of the guiding cylinder 22 are inserted into and latched to the inner peripheral step portion 23*a* (a peripheral portion of the circular opening) of the cam main body 23 from the front end side. By inserting the front end portion of the engagement projection projecting frontward from the partition wall of the eraser holder 14*a* into the center of the three latch flanges 22*b* thus latched from the rear end side, the guiding cylinder 22 is latched to the cam main body 23 so as to be capable of rotating relative thereto. A latch groove 23*b* is formed in an outer peripheral wall of the cam main body 23. By engaging the latch groove 23*b* with a projection 12*a* projecting radially inward from an inner peripheral wall of the rear barrel 12, the cam main body 23 is fixed to the rear barrel 12 so as to be incapable of rotating relative thereto. According to this configuration, the integrally assembled guiding cylinder 22, fitting cylinder 21, and front barrel 11 are capable of rotating relative to the cam main body 23 and the rear barrel 12. The front barrel 11 and the rear barrel 12 rotate relative to each other using the central axis of the barrel as a rotary axis, and therefore the cam main body 23 rotates about the central axis of the barrel.

The ball pen writing shafts 30 each include a refill 301, a rear end shaft 302, and a joint 303, the refill 301 having a writing tip including a ball that lays down ink by rotating, and a core pipe for housing the ink. A rear end of the refill 301 is connected to a front end of the joint 303, and a front end of the rear end shaft 302 is connected to a rear end of the joint 303.

The mechanical pencil writing shaft 31 includes a lead tank 312 for housing the writing lead, and a writing tip 311 having a chuck that can be used to feed out the writing lead housed in the lead tank 312 toward the front end side and clamp the writing lead. A rear end of the writing tip 311 is connected to a front end of the lead tank 312.

The sliders 41 are members that are coupled respectively to rear ends of the plurality of writing shafts, or more specifically either a rear end of the rear end shaft 302 of the ball pen writing shaft 30 or a rear end of the lead tank 312 of the mechanical pencil writing shaft 31. A cam 41*a* that projects radially outward toward the barrel is formed on each slider 41, and the cam 41*a* has a sliding contact surface that faces the rear end side of the composite writing implement 1 and extends substantially in a V shape when seen in an outer radial direction. The three sliders 41 are disposed in positions separated from each other by 120 degrees in a circumferential direction about the central axis of the composite writing implement 1, which serves as the rotary axis when the front barrel 11 and the rear barrel 12 rotate relative to each other.

The springs 42 are compressed coil springs that are wound respectively around the plurality of writing shafts (more specifically, either the rear end shaft 302 or the lead tank 312) so as to be interposed between the slider 41 and the partition 22*c* of the guiding cylinder 22. The sliders 41 are respectively biased toward the rear end side at all times by a restoring force of the springs 42. As a result, the sliding contact surfaces of the cams 41*a* of the respective sliders 41, which are formed to face the rear end side of the composite writing implement 1 (i.e. such that the contact surfaces of the cams 41*a* direct toward the rear end side), are biased at all times against an end surface (a cam driving curved surface) of the cam main body 23, which is formed to face the front end side of the composite writing implement 1 (i.e. such that the contact surfaces of the cam main body 23 direct toward the front end side).

Referring to FIGS. 3 to 6, the end surface (the cam driving curved surface) of the cam main body 23 will be described. FIG. 3 is a view illustrating the cam main body 23 from the rear. FIG. 4 is a view illustrating the cam main body 23 in an A-A direction, deployed along a plane that includes the central axis thereof. FIG. 5 is a view illustrating the cam main body 23 in a B-B direction, deployed along a plane that includes the central axis thereof and is orthogonal to the cross-section of FIG. 4. FIG. 6 is a view illustrating the cam main body 23 in the direction of an arrow C in FIG. 4. The cam main body 23 includes the cam projection 230 projecting toward the front end side of the composite writing implement 1, an end surface 231 formed to extend along the cam projection 230 so as to face the front end side of the composite writing implement 1, and a latch recess 232 formed in an apex part of the cam projection 230 as a latch portion for latching the cam 41*a* of the slider 41. Here, the apex part of the cam projection 230 denotes a central part of the projection forming the cam projection 230, i.e. the part of the end surface 231 positioned furthest toward the front end side. The sliding contact surface of the cam 41*a* of the slider 41, which is disposed opposite the end surface 231, slides along the end surface 231 such that in a projecting condition, in which the writing shaft projects toward the front end side, the sliding contact surface is latched inside the latch recess 232.

Referring to FIG. 7, the end surface 231 of the cam main body 23 will be described further. FIG. 7 is a deployment diagram illustrating the entire periphery of the end surface 231 of the cam main body 23, which extends in a circumferential direction about a central axis A, when deployed on a plane. The end surface 231 includes a front end side first inclined portion 231*a* having a front end side intersection angle (a first front end angle) formed at $2\theta_a$, and a rear end side second inclined portion 231*b* having a front end side intersection angle (a second front end angle) formed at $2\theta_b$. Here, the first front end angle $2\theta_a$ of the first inclined portion 231*a* is 38 degrees when developed on a plane, or to put it another way, a first incline angle $\theta_a$ from the central axis A of the barrel is 19 degrees, and therefore the incline angle relative to the central axis A is formed to be smaller (steeper/sharper) than that of a conventional composite writing implement. The second front end angle $2\theta_b$ of the second inclined portion 231*b*, meanwhile, is 46 degrees when developed on a plane, or to put it another way, a second incline angle $\theta_b$ from the central axis A is 23 degrees, and therefore the incline angle relative to the central axis A is formed to be larger (gentler) than the first incline angle $\theta_a$ of the first inclined portion 231*a*.

When this configuration is employed, an increase in an amount of rotary torque required during an operation to rotate the cam main body 23 can be suppressed even in a case where the movement amount of the writing shaft is increased by making the first incline angle $\theta_a$ of the first inclined portion 231*a* relative to the central axis A smaller than that of a conventional composite writing implement. By providing the second inclined portion 231*b*, a user can commence the operation to rotate the cam main body 23 easily at the start of the rotation operation, and therefore the operability of the composite writing implement 1 can be improved. Further, when a certain rotational speed (rotational inertia) is obtained by the user during the rotation operation, an operation to rotate the first inclined portion 231*a* can be performed, and therefore the user can easily cause the writing shaft to project. Furthermore, by forming the first inclined portion 231*a* to incline by the first incline angle $\theta_a$ relative to the central axis A, which is smaller than the conventional angle, the writing shaft can be used while projecting from the barrel of the composite writing implement 1 by a larger projection amount than in a conventional composite writing implement, and therefore the user can use the composite writing implement 1 more easily. Moreover, when housing the writing shaft in the barrel, the writing shaft, which is biased rearward at all times by the spring 42, is housed in the barrel at a higher accelerated speed than in a conventional composite writing implement due to the first inclined portion 231*a* formed to be inclined by the first incline angle $\theta_a$ relative to the central axis A, which is smaller than the conventional angle. The writing shaft can therefore be housed in the barrel more quickly than in a conventional composite writing implement, and as a result, the operability of the composite writing implement 1 can be further improved.

The end surface 231 of the cam main body 23 also includes a third inclined portion 231*c* that connects the first inclined portion 231*a* to the second inclined portion 231*b*. A third incline angle of the third inclined portion 231*c* relative to the central axis A is formed to be even larger (gentler) than the second incline angle $\theta_b$ of the second inclined portion 231*b*. When this configuration is employed, the cam 41*a* of the slider 41, while sliding along the third inclined portion 231*c*, can be driven to advance using an even smaller amount of rotary torque than that required when the cam 41*a* slides along the second inclined portion 231*b*. Hence, the rotational speed (rotational inertia) of the operation performed by the user to rotate the cam main body 23 can be increased rapidly in advance, thereby canceling out a rapid increase in the amount of rotary torque required during the operation to rotate the cam main body 23 that occurs when starting to slide the cam 41*a* of the slider 41 along the first inclined portion 231*a*. As a result, the operability of the composite writing implement 1 can be even further improved.

Moreover, a connecting portion between the first inclined portion 231*a* and the third inclined portion 231*c* and a connecting portion between the second inclined portion 231*b* and the third inclined portion 231*c* are formed as curved surfaces, and the incline angles between the inclined portions are set to vary continuously. When this configuration is employed, variation in the amount of rotary torque required during the operation to rotate the cam main body 23 can be suppressed, and the rotary torque can be set to vary continuously. As a result, the operability of the composite writing implement 1 can be even further improved.

The end surface 231 of the cam main body 23 also includes a fourth inclined portion 231*d*. The fourth inclined portion 231*d* is inclined in a position opposing the latch recess 232 in the circumferential direction of the cam main body 23 so as to form a rear end recess in which the draw-in (retract) amount of the writing shaft reaches a maximum. When this configuration is employed, the draw-in amount of the writing shaft can be further increased, and a rotational reaction force can be generated in a direction for inducing the cam main body 23 to rotate to a rotational position in which the draw-in amount of the writing shaft reaches the maximum. The user can perform the operation to rotate the cam main body 23 while sensing the rotational reaction force generated by the fourth inclined portion 231*d*, and can therefore house the writing shaft in a housing position in which the writing shaft is maximally withdrawn. Hence, the writing shaft can be drawn and housed in the barrel by a sufficient amount to prevent breakage, and can also be prevented from projecting unintentionally.

Furthermore, when a connecting portion between the fourth inclined portion 231*d* and the second inclined portion 231*b* is formed as a curved surface and the incline angle between the inclined portions is formed to vary continuously, similarly to the third inclined portion 231*c* described above, variation in the amount of rotary torque required during the operation to rotate the cam main body 23 can be suppressed, and the rotary torque can be set to vary continuously. As a result, the operability of the composite writing implement 1 can be even further improved.

Referring to FIGS. 8 to 11, an operation to rotate the composite writing implement 1 will be described further. FIGS. 8 and 9 are views illustrating a relationship between the cam main body 23 and the cams 41*a* of the sliders 41 in the housed (retracted) condition, FIG. 9 being a deployment diagram illustrating the relationship between the cam main body 23 and the cams 41*a* of the sliders 41 when deployed on a plane. In the housed condition illustrated in FIGS. 8 and 9, one cam 41*a* is positioned in the rear end recess formed by the fourth inclined portion 231*d*, and the two remaining cams 41*a* are positioned in the first inclined portion 231*a*. Thus, all of the writing shafts are withdrawn (retracted) to the rear end side so as to be housed in the barrel. The two cams 41*a* positioned in the first inclined portion 231*a* are positioned in substantially identical positions in the axial direction of the barrel such that a balanced biasing force is obtained between the respective springs 42 on the two cams 41*a*, while the single cam 41*a* is positioned in the rear end recess. Therefore, the positions of the three cams 41*a* in the housed condition are stable. When the composite writing implement 1 is switched from the projecting condition to the housed condition, the user is made aware that the composite writing implement 1 is in the housed condition by a clicking sensation produced when the single cam 41*a* is positioned in the rear end recess.

FIGS. 10 and 11 are views illustrating the relationship between the cam main body 23 and the cams 41*a* of the sliders 41 in the projecting condition, FIG. 11 being a deployment diagram illustrating the relationship between the cam main body 23 and the cams 41*a* of the sliders 41 when deployed on a plane. In the projecting condition illustrated in FIGS. 10 and 11, one cam 41*a* is positioned in the latch recess 232, and the two remaining cams 41*a* are positioned in the second inclined portion 231*b*. As a result, one of the writing shaft projects through the opening 11*a*.

In a conventional composite writing implement, when the incline angle of the end surface of the cam main body relative to the central axis is reduced, it is difficult to engage the cam of the slider with the latch recess of the cam main body using the inertia generated when causing a writing shaft to project, and therefore the cam may be rotated so as to fly over the latch recess instead of engaging with the latch recess. With the composite writing implement 1, however, in a condition where one writing shaft selected by the user is caused to project, the respective sliding contact surfaces of the cams 41*a* of the two remaining writing shafts contact the second inclined portion 231*b*, and as a result of this contact, the cam 41*a* latched to the latch recess 232 can be caused to obtain a generated rotational reaction force when traveling over the latch recess 232. Accordingly, the user can halt the rotation operation in the projecting condition where the selected writing shaft is latched to the latch recess 232, and as a result, the selected writing shaft can be caused to project with stability.

This embodiment of the present invention is cited as an example, and is not intended to limit the scope of the invention. This novel embodiment may be implemented in various other forms, and various omissions, replacements, and modifications may be applied thereto within a scope that does not depart from the spirit of the invention. The embodiment and modification thereof are included within the scope and spirit of the invention, and are also included in the inventions described in the claims and within the scope of equivalents thereto.

REFERENCE SIGNS LIST

1 Composite writing implement
11 Front barrel
12 Rear barrel
23 Cam main body
30 Ball pen writing shaft
31 Mechanical pencil writing shaft
41 Slider
41*a* Cam
230 Cam projection
231 End surface
231*a* First inclined portion
231*b* Second inclined portion
231*c* Third inclined portion
231*d* Fourth inclined portion
232 Latch recess

The invention claimed is:

1. A composite writing implement, comprising:

a barrel having an opening provided in a front end side thereof;

a plurality of writing shafts housed in the barrel;

a cam main body configured to rotate about a central axis of the barrel, and including a cam projection projecting toward the front end side, an end surface extending along the cam projection so as to face the front end side, and a latch recess provided in an apex part of the cam projection; and a plurality of sliders configured to be connected to respective rear ends of the plurality of writing shafts, each of the sliders including a cam configured to be latchable to the latch recess of the cam main body, and having a sliding contact surface facing a rear end side to be pressed against the end surface, wherein the end surface includes a first inclined portion that is positioned on the front end side of the cam projection and is inclined relative to the central axis by a first incline angle, and a second inclined portion that is positioned further toward the rear end side of the cam projection than the first inclined portion, and is inclined relative to the central axis by a second incline angle that is larger than the first incline angle, wherein, when one of the plurality of writing shafts is caused to project, the sliding contact surfaces of the sliders of other writing shafts contact the second inclined portion of the end surface of the cam main body, and as a result of the contact, the cam of the slider latched to the latch recess is configured to obtain a generated rotational reaction force when traveling over the latch recess, and wherein the end surface further includes a third inclined portion that connects the first inclined portion to the second inclined portion, and is inclined relative to the central axis at a third incline angle that is larger than the second incline angle.

2. The composite writing implement according to claim 1, wherein a connecting portion between the first inclined portion and the third inclined portion, and another connecting portion between the second inclined portion and the third inclined portion, are formed as curved surfaces.

3. The composite writing implement according to claim 1, further comprising a fourth inclined portion forming a rear end recess in which a draw-in amount of the writing shaft reaches a maximum in a position opposing the latch recess in a circumferential direction of the cam main body.

4. The composite writing implement according to claim 1, wherein the end surface further includes a fourth inclined portion forming a rear end recess.

5. The composite writing implement according to claim 4, wherein, in the rear end recess, a draw-in amount of the writing shaft reaches a maximum in a position opposing the latch recess in a circumferential direction of the cam main body.

6. The composite writing implement according to claim 5, wherein the fourth inclined portion continuously extends from the second inclined portion.

7. The composite writing implement according to claim 5, wherein a connecting portion between the second inclined portion and the fourth inclined portion includes a curved surface.

8. The composite writing implement according to claim 1, wherein, after said one of the plurality of writing shafts is caused to project, the sliding contact surfaces of each of the sliders of the other writing shafts contact the second inclined portion of the end surface of the cam main body.

9. The composite writing implement according to claim 1, wherein, after said one of the plurality of writing shafts is caused to project, the sliding contact surfaces of each of the sliders of the other writing shafts only contact the second inclined portion of the end surface of the cam main body.

10. The composite writing implement according to claim 1, wherein, after said one of the plurality of writing shafts is caused to project, the sliding contact surfaces of each of the sliders of the other writing shafts abut the second inclined portion of the end surface of the cam main body.

11. The composite writing implement according to claim 1, wherein, after said one of the plurality of writing shafts is caused to project, the sliding contact surfaces of each of the sliders of the other writing shafts are biased at all times against the end surface of the cam main body.

12. A composite writing implement, comprising:

a barrel having an opening provided in a front end side thereof;

a plurality of writing shafts housed in the barrel;

a cam main body configured to rotate about a central axis of the barrel, and including a cam projection projecting toward the front end side, an end surface extending along the cam projection so as to face the front end side, and a latch recess; and a plurality of sliders configured to be connected to respective rear ends of the plurality of writing shafts, each of the sliders including a cam configured to be latchable to the latch recess, and having a sliding contact surface facing a rear end side to be pressed against the end surface, wherein the end surface includes a first inclined portion that is positioned on the front end side of the cam projection and is inclined relative to the central axis by a first incline angle, and a second inclined portion that is positioned further toward the rear end side of the cam projection than the first inclined portion, and is inclined relative to the central axis by a second incline angle that is larger than the first incline angle, wherein, after one of the plurality of writing shafts is caused to project, the sliding contact surfaces of the sliders of remaining writing shafts contact the second inclined portion of the end surface of the cam main body, and wherein the end surface further includes a third inclined portion that connects the first inclined portion to the second inclined portion, and is inclined relative to the central axis at a third incline angle that is larger than the second incline angle.

13. The composite writing implement according to claim 12, wherein the end surface further includes a fourth inclined portion forming a rear end recess.

14. The composite writing implement according to claim 13, wherein, in the rear end recess, a draw-in amount of the writing shaft reaches a maximum in a position opposing the latch recess in a circumferential direction of the cam main body.

* * * * *